United States Patent [19]

Deveson

[11] 4,088,243

[45] May 9, 1978

[54] ICE MAKING AND VENDING MACHINES

[76] Inventor: Maxwell Ivan Deveson, 82 Albert Street, Mordialloc, 3195, Victoria, Australia

[21] Appl. No.: 727,530

[22] Filed: Sep. 28, 1976

[51] Int. Cl.[2] ..... B65H 17/04

[52] U.S. Cl. ..... 221/93; 221/150 R; 62/344

[58] Field of Search ..... 221/112, 150 B, 93, 221/201, 203; 62/344; 222/227, 228, 242, 146 C

[56] References Cited

U.S. PATENT DOCUMENTS

| | | | |
|---|---|---|---|
| 3,021,687 | 2/1962 | Dawson et al. | 62/344 X |
| 3,075,363 | 1/1963 | Conto | 62/344 X |
| 3,151,668 | 10/1964 | Zimmermann | 222/146 C |

*Primary Examiner*—Stanley H. Tollberg
*Attorney, Agent, or Firm*—Donald D. Jeffery

[57] ABSTRACT

A coin operated ice-making and vending machine wherein small blocks of ice made in an ice-making unit fall into a storage compartment where they are prevented from forming into larger masses, and from whence they fall into a customer held container upon actuation of a coin operated mechanism which opens a chute in the base of the storage compartment.

8 Claims, 6 Drawing Figures

ICE MAKING AND VENDING MACHINES

The present invention relates to ice making and vending machines of the type wherein upon insertion of preselected coins, a polyethylene bag is released, which the customer holds under an outlet spout to collect a predetermined quantity of ice.

The object of the present invention is to improve and simplify the construction and operation of such machines.

A further object is to provide a construction whereby it is less easy to cheat the machine, and wherein less water is delivered with each quantity of ice.

Accordingly the present invention provides an ice making and vending machine comprising at least one ice making unit sitting on a tiltable tray which when activated tilts or tips and allows ice from the ice making unit to be delivered into an insulated storage cylinder below, the storage cylinder having an outlet for ice on its base, the outlet having a plate thereover to prevent ice from falling freely through the outlet, a motor driven spindle supporting a part-open plate extending across the cylinder adjacent its base and a number of radial paddles which rotate with the spindle at the base of the cylinder to sweep ice from the opening in said part-open plate into the outlet, and preferably a bag dispensing unit located within or adjacent the ice making and vending machine, said unit comprising a roller carrying a long length of preformed and perforated polyethylene bags, each bag having an attached polyethylene tie, the bags and ties being fed between two further rolls which upon insertion of the preselected coins, turn to expose a single bag and tie which may then be torn from the roll, separated, the bag being used to collect ice from the outlet of the storage cylinder and then the tie used to fasten the near full bag of ice.

Preferably upper and lower level control bars are provided in the storage cylinder, said control bars being of aluminum, whereby measurement of their resistance provides indication as to whether they are surrounded by ice or not and so whether the cylinder is full of empty.

In order to minimize the amount of water associated with the ice, the tray into which the refrigerated fingers of the ice making unit extend during ice making, is adapted, upon completion of ice making to tilt away from the fingers so that water on the ice on the fingers may drain off before the ice is released.

But in order that the invention may be more clearly understood, reference will now be made to the accompanying drawings wherein.

The drawings have been simplified by the omission of the various components which serve to provide the refrigeration to the system, such components, their displacement, operation and purpose being known and not forming part of the present invention.

Figure 1:
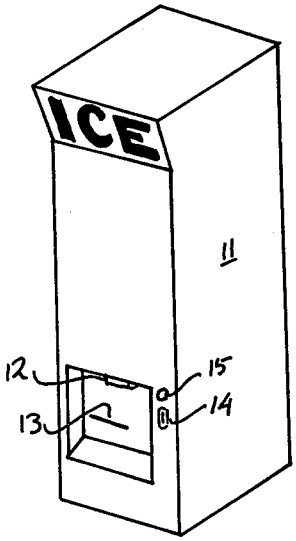
FIG. 1 is a perspective view of the ice making and vending machine.
Figure 4:
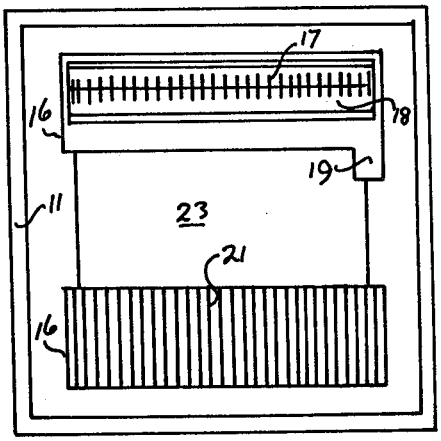
FIG. 4 is a cross-section taken on the plane IV—IV of FIG. 2.
Figure 5:
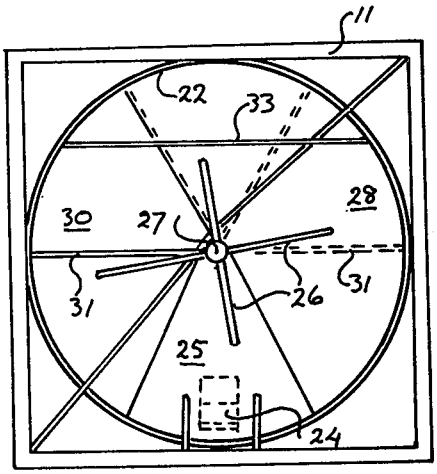
FIG. 5 is a cross-section taken on the plane V—V of FIG. 2.
Figure 6:
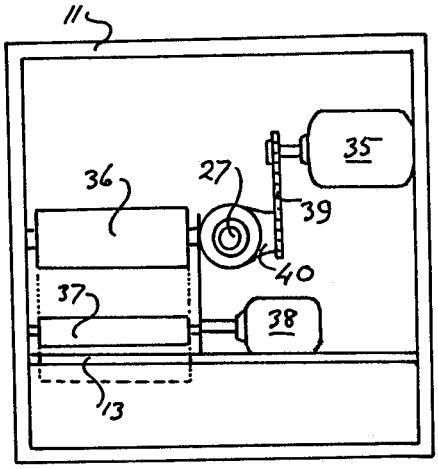
FIG. 6 is a cross-section taken on the plane VI—VI of FIG. 2.
Figure 2:
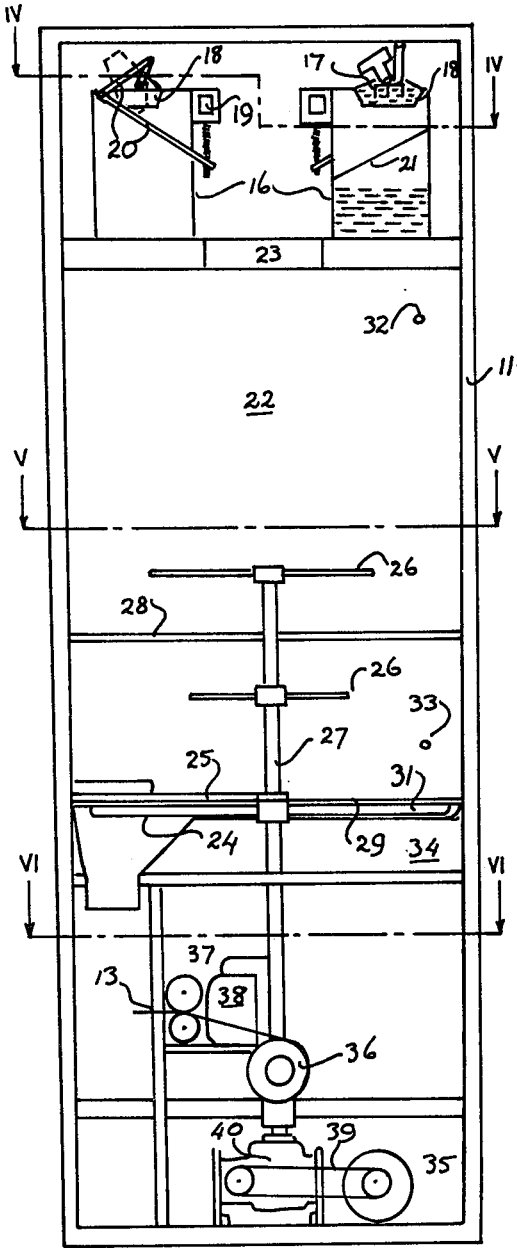
FIG. 2 is a side elevation thereof.
Figure 3:
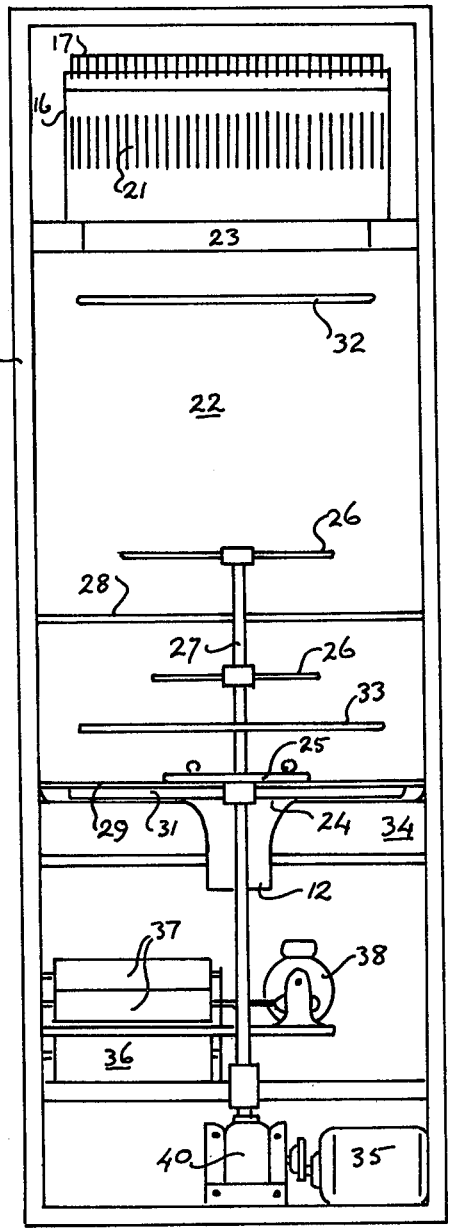
FIG. 3 is a front elevation thereof.

The ice making and vending machine shown in FIG. 1 is enclosed in a rectangular cabinet 11, with an inset chute 12 from which ice is discharged and over which a bag, dispensed from slot 13 may be held to collect the ice, a coin receiving mechanism 14 and discharge button 15 adjacent the inset to allow the customer to operate the machine.

The ice is made conventionally in ice making unit 16, two of which are located at the top of the cabinet, a series of refrigerated fingers 17 being inserted into a pair of tiltable trays 18 of water to a predetermined depth. Water is pumped into the two top tanks on a predetermined time cycle by means of a pump (not shown).

On completion of the ice making cycle, the trays 18 tilt about their longitudinal axis to allow water to drain therefrom, a solenoid 19 through a system of levers 20 activating the tilting. The tilting action moves the trays clear of the fingers 17, the ice remaining on the fingers. The refrigeration cycle goes into a hot gas defrost so that the ice on the fingers 17 is released and, falling clear of the trays, is deflected by a sloping screen 21 into an insulated storage cylinder 22 located below the trays 18 and ice making unit 16, the latter two being enclosed in a canopy, any water remaining with the ice falling through the screen.

After the ice has been released from the fingers, the trays return to their original position and the cycle begins again.

The storage cylinder 22 comprises a simple insulated cylinder having a top inlet 23 and a bottom outlet 24, ice dropping through the cylinder under gravity. The bottom outlet is covered by a fixed plate 25 to prevent constant discharge of ice. Two sets of radial arms 26, mounted on and driven by a central spindle 27, are located above plate 25 in the cylinder 22 in order to keep the ice in small lumps and prevent localised freezing into large masses. Further a plastic covered rod 28 extends diametrically across the cylinder midway between the two sets of radial arms, rod 28 also acting as an ice breaker bar to keep the ice in small pieces and preventing it from rotating about the spindle 27 as a single large mass. In the space between the base of the cylinder and the plate 25 is located a second plate 29 having an open sector 30 through which is delivered a quantity of ice and attached to plate 29 a number of radial paddles 31, preferably six, radiating from the central spindle 27 which also drives the plate 29 and the paddles 31, enabling the paddles to scrape a predetermined quantity of ice falling through the part-open plate 29 into the outlet. The open sector 30 is so dimensioned that sufficient ice is delivered to the outlet upon a turn of the spindle.

Also located in and extending across the storage cylinder 22 are the upper and lower level control bars 32 and 33 respectively. The control bars are of aluminum and are used to indicate the level of the ice within the storage cylinder by measurement of the resistance of the bars, the resistance varying with the presence of ice, thereby providing electronic sensor means to indicate when the machine (cylinder) is full or empty of ice.

The storage cylinder 22 is located in a cabinet 11, a layer of insulation 34 supporting the cylinder 22 and separating it from the space wherein is located a refrigeration unit (not shown), a bag dispensing mechanism, a coin operating mechanism (not shown), an electric motor 35 to drive the spindle 27, and a discharge chute 12 for ice from the storage cylinder 22.

The bag dispensing mechanism comprises a freely rolling roll 36 of polyethylene bags and ties arranged end to end, the bags having perforations for easy separation, a black spot on the bag for sighting by a photoelectric cell (not shown) to ensure a predetermined length of bag is delivered each time, and a polyethylene tie extending centrally along the length of the bag and attached thereto at either end, the roll of bags and ties being led through a pair of tensioned rollers 37 such that on activation of a separate motor 38 driving the pair of rollers, these rollers are rotated to allow one bag length and tie to pass therethrough so that a customer may obtain a bag and tie and readily separate the two, then use the bag to collect ice which will be discharged through the chute after pressing of an ice discharge button 15, and finally use the tie to close the near full bag of ice so that it is readily transportable.

An electro-mechanical system (not shown) is arranged so that upon insertion of the preselected coins, a system of microswitches and solid state controls is activated such that the tensioning rollers 37 advance a bag through slot 13. Then the bag and tie are torn from their roll and positioned under the discharge chute 12 by the customer, the customer next pressing button 15 to activate the motor 35 which, via a chain drive 39 and gearbox 40, drives the spindle so that the arms and paddles rotate to move a predetermined quantity of ice past the plate 25 into the outlet 24 and discharge chute 12.

From the above it will be seen that the present invention provides a fully automatic ice making and vending machine which is simple in operation and construction, providing relatively 'dry' ice.

I claim:

1. An ice making and vending machine comprising at least one ice making unit sitting on a tiltable tray which when activated tilts or tips and allows ice from the ice making unit to be delivered into an insulated storage cylinder below, the storage cylinder having an outlet for ice on its base, the outlet having a first plate thereover to prevent ice from falling freely through the outlet, a motor driven spindle supporting for rotation a second plate extending across the cylinder adjacent its base and having an open sector therein, a number of radial paddles which rotate with the spindle at the base of the cylinder below both said plates to sweep ice from the open sector in the second plate into the outlet, and upper and lower control bars in said storage cylinder, said control bars being of a suitable metal the measurement of the resistance of which provides indication as to whether said bars are or are not surrounded by ice, and thus the extent to which said cylinder is filled with ice.

2. An ice making and vending machine as claimed in claim 1 further including a bag dispensing unit located within or adjacent the ice making and vending machine, said unit comprising a roller carrying a long length of preformed and perforated polyethylene bags, each bag having an attached polyethylene tie, the bags and ties being fed between two further rolls which, upon insertion of the preselected coins, turn to expose a single bag and tie which may then be torn from the roll, separated, the bag being used to collect ice from the outlet of the storage cylinder and then the tie used to fasten the near full bag of ice.

3. An ice making and vending machine as claimed in claim 1 having two or more ice making units.

4. An ice making and vending machine as claimed in claim 1 further including at least one pair of radial arms mounted on and driven by said spindle above said plates and within the storage cylinder to prevent localized freezing together of ice particles with the cylinder.

5. An ice making and vending machine as claimed in claim 1 further including a ice breaker bar extending diametrically across the storage cylinder above said plates to break up any large masses of ice.

6. An ice making and vending machine as claimed in claim 1 further including a series of refrigerated fingers inserted in said tiltable tray, the ice being formed in said tray around said fingers.

7. An ice making and vending machine as claimed in claim 1 in which said control bars are of aluminum.

8. An ice making and vending machine as claimed in claim 6 further including a sloping screen positioned below said tray and over which said ice passes into said storage cylinder, any water remaining with the ice falling through the screen for separate collection.

* * * * *